US006360460B2

(12) United States Patent
Grandpierre

(10) Patent No.: US 6,360,460 B2
(45) Date of Patent: Mar. 26, 2002

(54) DRYER-IRONER WITH HEATED IRONING CUP AND HEAT CARRYING FLUID

(75) Inventor: Cyril Marc Michel Grandpierre, Troyes (FR)

(73) Assignee: Electrolux Systemes de Blanchisserie, Rosieres-pres-Troyes (FR)

( * ) Notice: Subject to any disclaimer, the term of this patent is extended or adjusted under 35 U.S.C. 154(b) by 0 days.

(21) Appl. No.: 09/791,451

(22) Filed: Feb. 22, 2001

(30) Foreign Application Priority Data

Feb. 23, 2000 (FR) ..... 00 02232

(51) Int. Cl.[7] ..... D06F 63/00; D06F 65/06
(52) U.S. Cl. ..... 38/66; 38/4
(58) Field of Search ..... 38/66, 68, 44, 38/47, 16, 18, 64

(56) References Cited

U.S. PATENT DOCUMENTS 4,418,486 A * 12/1983 Kober ..... 38/44 X
5,022,169 A * 6/1991 Jensen ..... 38/44 X

FOREIGN PATENT DOCUMENTS

| | | | |
|---|---|---|---|
| BE | 1 009 978 | 11/1997 | |
| DE | 860 940 | 12/1952 | |
| DE | 1280802 | * 6/1961 | ..... 38/44 |
| EP | 0 332 840 | 9/1989 | |
| FR | 1 135 197 | 4/1957 | |
| FR | 1 332 810 | 12/1963 | |

* cited by examiner

*Primary Examiner*—Ismael Izaguirre
(74) *Attorney, Agent, or Firm*—Pearne & Gordon LLP

(57) ABSTRACT

Dryer-ironer with heated ironing cup and heat-carrying fluid.

In a dryer-ironer with heated cup (10), the cup is built so as to define a closed chamber (26) containing a heat carrying fluid between two parallel walls (18, 22). The fluid is set into motion through a stirring system integrated with the cup so as to provide the establishment of a uniform temperature along its entire length.

4 Claims, 2 Drawing Sheets

DRYER-IRONER WITH HEATED IRONING CUP AND HEAT CARRYING FLUID

DESCRIPTION

1. Technical Field

The present invention relates to a dryer-ironer wherein the laundry is ironed between a heated ironing cup and a rotating roller.

The dryer-ironer according to the invention may be used in all cases where relatively large amounts of laundry must be frequently ironed. Thus and uniquely as an example, such a machine may be used in hospital institutions, nursing homes, lodging houses, hotels, restaurants, etc.

2. State of the Art

In dryers-ironers with a cup, ironing of the laundry is performed between a metal ironing cup, in the shape of a cylindrical sector with a generally horizontal axis, and a pressing roller covered with baize, the axis of which coincides with that of the cup and the lower portion of which rests on said cup. When the machine is operating, the pressing roller is driven into rotation around its axis. Consequently, the pieces of laundry to be ironed, inserted between the cup and the roller on one side of the machine, come out on the other side.

For ironing of laundry to be carried out in the best possible conditions, the ironing cup is provided with heating means. Depending on the machines, these heating means may either be totally integrated into the machine, or else placed outside the latter.

When the heating means of the ironing cup are integrated into the dryer-ironer, they may be of different types, depending on the machines. Hence, these heating means may notably consist of gas manifolds, electric resistances, infrared heating devices, etc.

Machines of this type provide the advantage of being simple and not very expensive and of having excellent cost effectiveness.

On the other hand, they have the drawback that the cup is uniformly heated on its entire length, regardless of the areas where the pieces of laundry are inserted during ironing. Consequently, after ironing a piece of laundry in a given area of the ironing cup, this area is at a lower temperature than the value required for the ironing, whereas the other areas of the cup, which continue to be heated, are on the contrary at a higher temperature than this value. Consequently, the next piece of laundry will be badly ironed if it is inserted in the same area as the previous one or be burnt if it is inserted in a different area. Actually, the thermal gradient even increases if several pieces of laundry are successively inserted substantially in the same area.

Dryers-ironers wherein the ironing cup is heated by means located outside the machine, use a heat carrying fluid. This heat carrying fluid is heated in a boiler located outside the machine, before being fed into the cup by a pump also placed outside the machine.

Contrary to dryers-ironers wherein the heating means of the cup are integrated into the machine, dryers-ironers with a heat carrying fluid are able to provide good heat diffusion on the entire length of the cup, regardless of the areas into which are inserted the pieces of laundry.

On the other hand, these machines have the drawbacks of requiring heavy, expensive and complex external facilities.

When several dryers-ironers are placed in a same building, these drawbacks sometimes result in that the users feed these machines with heat carrying fluid simultaneously, from a unique circuit integrating a single boiler and a single pump. However, such facilities are only feasible if several dryers-ironers are used simultaneously and they remain more expensive and more complex than facilities using machines with integrated heating.

DESCRIPTION OF THE INVENTION

Specifically, the object of the invention is a dryer-ironer with heated cup, its original design allows it to benefit both from cost effectiveness and cost advantages specific to machines with integrated heating and from the advantages provided by uniform diffusion of heat on the entire length of the cup of machines which are heated through a heat carrying fluid.

According to the invention, this result is obtained by means of a dryer-ironer comprising an ironing cup in the shape of a cylindrical sector provided with an internal wall, able to come into contact with the laundry to be ironed, and means for heating said wall, characterized in that the cup further comprises an external wall which externally lines, at a distance, the internal wall, directly close to the heating means, so as to delimit with said internal wall, a closed chamber filled with a heat carrying fluid able to transfer heat produced by heating means to the internal wall, and stirring means able to generate a circulation of heat carrying fluid within said chamber.

The machine according to the invention has integrated heating means. It thus benefits from economical advantages and from the excellent cost effectiveness both specific to this type of machine.

On the other hand, the use of a heat carrying fluid put into circulation by stirring means also integrated into the machine, provides effective diffusion of heat over the entire length of the ironing cup, as in machines using an external boiler.

In a preferred embodiment of the invention, the stirring means comprise partitions positioned in a staggered configuration within the closed chamber, in order to delimit between the internal and external walls, a path for reciprocating motion, substantially parallel to an axis of the cylindrical sector formed by the cup. The stirring means also comprise driving means such as a pump in order to cause the heat carrying fluid to circulate along this path.

The heating means, which may assume any shape as in existing machines with integrated heating, are advantageously placed outside the closed chamber.

Moreover, the internal wall of the cup is advantageously made of stainless steel and the external wall of ordinary steel.

BRIEF DESCRIPTION OF THE DRAWINGS

A preferred embodiment of the invention will now be described as a non-limiting example, with reference to the appended drawings, wherein.

DETAILED DESCRIPTION OF A REFERRED EMBODIMENT

Figure 1:
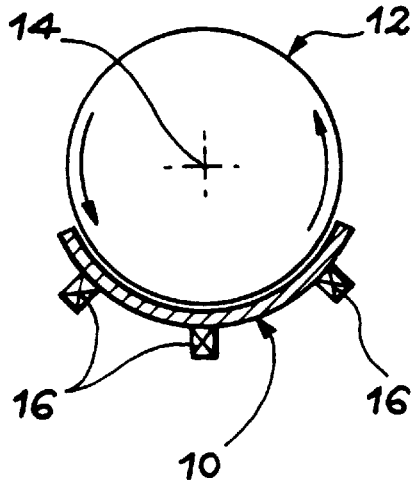
FIG. 1 is a sectional view which very schematically illustrates a dryer-ironer according to the invention.

As illustrated in FIG. 1 very schematically, the dryer-ironer according to the invention primarily comprises an ironing cup 10 and a roller 12 covered with baize. This type of machine is well known to one skilled in the art, so that only the features required for a good understanding of the invention will be described.

The ironing cup 10 is mounted on a fixed chassis (not shown). It is made of a metal such as stainless steel and has, according to the invention, a particular structure which will be described later on. Generally, the ironing cup 10 assumes the shape of a cylindrical sector, the axis of which 14 is substantially horizontal and the recessed portion of which is turned upwards.

Roller 12 appears with the shape of a hollow cylinder, the external peripheral surface of which is covered with baize. Roller 12 is coaxially mounted on cup 10. It is supported by the chassis of the machine, so that it may rotate around axis 14. A geared motor (not shown) enables the roller 12 to rotate about axis 14 in the direction of the arrows in FIG. 1. In addition, elastic means (not shown) interposed between the chassis and cup 10, apply the latter against the lower portion of cylinder 12.

In the dryers-ironers of this type, the pieces of laundry to be ironed are inserted one after the other on one side of the machine (on the left in FIG. 1) between cup 10 and roller 12, each piece of laundry comes out of the machine, ironed, on the opposite side (on the right in FIG. 1).

As illustrated schematically in FIG. 1, the dryer-ironer according to the invention also comprises means 16 for heating the ironing cup 10, integrated into the machine. These heating means 16 may comprise any heating means usually used on dryers-ironers with integrated heating cups. Thus, and uniquely as an example, these may be gas manifolds, electric resistances, infrared devices, etc.

Figure 2:
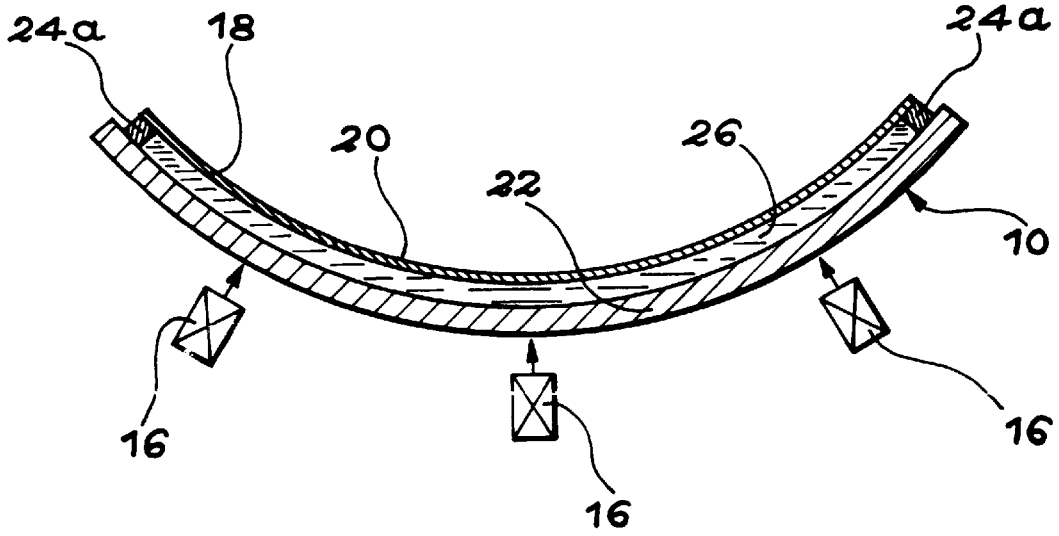
FIG. 2 is a sectional view, which schematically illustrates at a larger scale the ironing cup of the machine of FIG. 1 and the associated heating means.

As further illustrated in detail in FIG. 2, the ironing cup 10 comprises, according to the invention, two parallel walls, at a distance from one another so as to delimit between each other a closed chamber of substantially uniform thickness.

More specifically, cup 10 comprises an internal wall 18, in the shape of a cylindrical sector, preferably made of stainless steel. The internal surface 20 of internal wall 18 is a smooth surface which comes directly into contact with the laundry to be ironed. This wall 18 is preferably relatively thin. As an absolutely non-limiting illustration, internal wall 18 may have a thickness between 1.5 mm and 2 mm, depending on the size of the machine.

The ironing cup 10 also comprises an external wall 22 which lines the internal wall 18, on the side of its convex lower face, at a distance from the latter. The substantially uniform distance separating walls 18 and 22 may for example, be about 5 mm. The external wall 22 is made of metal such as ordinary steel, it is substantially thicker than the internal wall 18. Thus, the thickness of the external wall varies, for example, between 4 mm and 6 mm, depending on the size on the machine.

The internal wall 18 is fixed on the upper face of the external wall 2 through two rectilinear shims 24*a* positioned along the longitudinal edges of both walls and of both shims in a circular arc 24*b* (FIG. 3) positioned along the curved edges of both walls. Shims 24*a* and 24*b* may notably be welded onto the upper face of external wall 22, after which, the edges of internal wall 18 are themselves welded onto shims 24*a*, 24*b*.

A closed chamber 26, sealed relatively to the outside world is thereby delimited between walls 18 and 22. This chamber 26 is at least partly filled with a heat carrying fluid. This heat carrying fluid may comprise any fluid usually used in dryers-ironers, the cup of which is heated by a heat carrying fluid. This fluid is, for example and in a non-limiting way, a liquid such as oil. In order to take into account thermal expansions of the heat carrying fluid contained in chamber 26, the latter may be connected with an expansion vessel (not shown) also integrated into the machine.

As illustrated schematically in FIG. 2, heating means 16 are placed outside cup 10, below the latter and directly close to wall 22. Therefore, heating means 16 directly heat the thick external wall 22 of the cup. Heat is then transferred to the internal thin wall 18 by the heat carrying fluid contained in chamber 26.

For the heat to uniformly diffuse over the internal face 20 of wall 18, during ironing, the dryer-ironer according to the invention further comprises stirring means also integrated into the machine. These stirring means are laid out so as to generate a circulation of heat carrying fluid within chamber 26, both in parallel to axis 14 of the cup, in order to homogenize the temperature, and between walls 22 and 18, in order to transfer heat released by heating means 16 to the internal wall 18. An embodiment of stirring means will now be described as an example with reference to FIG. 3.

In this figure, it is seen that the stirring means comprise both partitions positioned in chamber 26 and driving means 30, such as a pump in order to cause the heat carrying fluid to circulate along a path delimited by the partitions.

More specifically, the aforementioned partitions comprise a partition in a circular arc 28*a*, which extends close to one of the shims in a circular arc 24*b*, parallel to the latter, so as to delimit with the latter, a channel 32 in a circular arc. This channel 32 is divided into two portions of the same length by a partition 28*b*, with a parallel orientation with respect to the axis 14 of the cylindrical sector formed by the cup. The aforementioned partitions further comprise a series of rectilinear partitions 28*c*, with a parallel orientation one with respect to another, along axis 14 of the cylindrical sector formed by the cup. These rectilinear partitions 28*c* are regularly distributed between the two rectilinear shims 24*a*, so as to delimit between each other and with the latter, rectilinear channels 34. One out of two of the rectilinear partitions 28*c* is connected to the partition in a circular arc 28*a* and is interrupted at a certain distance from the shim in a circular arc 24*b*, the furthest one from this partition 28*a*. The other rectilinear partitions 28*c* are connected to this last shim in a circular arc 24*b* and interrupted at a certain distance from the partition in a circular arc 28*a*. In addition, among the rectilinear partitions 28*c* connected to the partition in a circular arc 28*a*, two partitions 28*c* are found, the closest to the rectilinear shims 24*a*, and the partition in a circular arc 28*a* is interrupted between both of these partitions 28*c* and shims 24*a*. Consequently both portions of the channel in a circular arc 32 separated by partition 28*b* communicate with both rectilinear channels 34 adjacent to rectilinear shims 24*a*, respectively.

A path for reciprocating motion is thus delimited between walls 18 and 22, with a parallel orientation with respect to axis 14 of the cylindrical sector formed by the cup.

Figure 3:
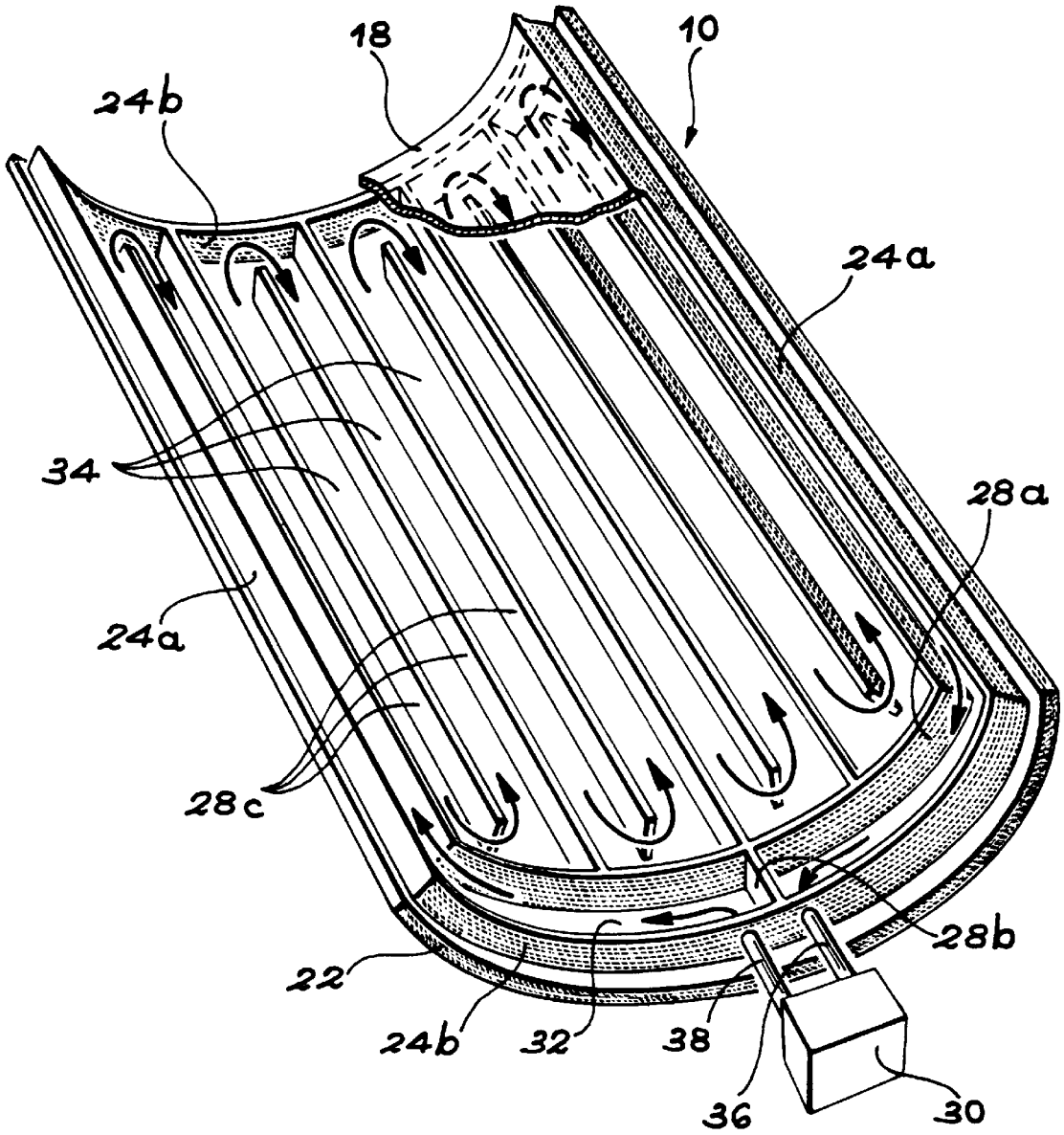
FIG. 3 is a perspective view with partial cutout, illustrating the ironing cup.

Pump 30 is connected to each of both portions of channel 32, on both sides of partition 28*b*, through suction piping 36 and discharge piping 38 respectively When pump 30 is actuated, circulation of the hydraulic fluid is thus generated in chamber 26, along the path illustrated by arrows in FIG. 3. This path, delimited by partitions 28*a*, 28*b* and 28*c*, is mainly characterized by a reciprocating movement of the fluid, parallel to axis 14 of the cylindrical sector formed by cup 10, virtually over the entire length of the latter.

It should be noted that partitions 28*a*, 28*b* and 28*c* preferably have a height substantially equal to that of shims 24*a*, 24*b*, i.e. substantially equal to the thickness of chamber 26. With this layout, any circulation of the heat carrying fluid other than the one imposed by the partitions may be prevented. With this layout, partitions 28*a*, 28*b*, and 28*c* may also serve as a support for the internal wall 18, which is relatively thin. The cylindrical geometry of the internal surface 20 of wall 18 is thus maintained in spite of the relative thin thickness of this wall.

Thanks to the characteristics which have just been described, the dryer-ironer according to the invention may guarantee excellent ironing quality because heat is uniformly diffused over the entire surface of the cup through the heat carrying fluid in motion.

Furthermore, the machine according to the invention is a simple machine and of a relatively limited cost, because it does not require the use of an external boiler.

Of course, the invention is not limited to the embodiment which has just been described as an example. Hence, the stirring means with which the cooling fluid may be forced to circulate in chamber 26, may be different from the described means. The same applies to the relative thicknesses for connecting these walls one to another by delimiting a closed chamber between them. Notably it is conceivable that the partitions are made of an embossed thin metal sheet, placed between partitions 18 and 22.

What is claimed is:

1. Dryer-ironer comprising an ironing cup in the shape of a cylindrical sector provided with an internal wall able to come into contact with the laundry to be ironed, and means for heating said wall, characterized in that the cup further comprises an external wall which externally lines, at a distance, the internal wall directly close to the heating means, so as to delimit with said internal wall a closed chamber filled with a heat carrying fluid able to transfer to the internal wall heat produced by the heating means, and stirring means able to generate a circulation of heat carrying fluid within said chamber;

wherein said stirring means comprise partitions in a staggered configuration in the closed chamber, in order to delimit between the internal and external walls, a path for reciprocating motion, substantially parallel to an axis of said cylindrical sector, and driving means for causing the heat carrying fluid to circulate along said path;

wherein said partitions have a height substantially equal to the thickness of the closed chamber, such that they serve as a support for the internal wall.

2. A dryer-ironer according to claim 1, wherein the heating means are placed outside the closed chamber.

3. A dryer-ironer according to claim 1, wherein the internal wall is made of stainless steel and the external wall of ordinary steel.

4. Dryer-ironer comprising an ironing cup in the shape of a cylindrical sector provided with an internal wall able to come into contact with the laundry to be ironed, and means for heating said wall, characterized in that the cup further comprises an external wall which externally lines, at a distance, the internal wall directly close to the heating means, so as to delimit with said internal wall a closed chamber filled with a heat carrying fluid able to transfer to the internal wall heat produced by the heating means, and stirring means able to generate a circulation of heat carrying fluid within said chamber, wherein the external wall is substantially thicker than the internal wall.

* * * * *